United States Patent [19]

Vogel

[11] 4,100,754

[45] Jul. 18, 1978

[54] METHOD AND APPARATUS FOR INSTALLING PIPES IN OFF-SHORE LOCATIONS

[76] Inventor: Rudolf Vogel, Jägerweg 6, D3320 Salzgitter 51, Fed. Rep. of Germany

[21] Appl. No.: 709,302

[22] Filed: Jul. 28, 1976

[51] Int. Cl.[2] ..... E02B 17/00; E21B 15/02

[52] U.S. Cl. ..... 61/98; 61/100; 175/7; 175/8; 175/9

[58] Field of Search ..... 61/87, 89, 94, 95, 96, 61/98, 99, 100; 175/7, 8, 9; 114/0.5 D

[56] References Cited

U.S. PATENT DOCUMENTS

| | | | |
|---|---|---|---|
| 2,857,744 | 10/1958 | Swiger et al. | 61/87 |
| 2,940,265 | 6/1960 | Doody et al. | 61/94 |
| 3,209,544 | 10/1965 | Borrmann | 61/87 |
| 3,670,507 | 6/1972 | Mott | 175/7 X |
| 3,685,300 | 8/1972 | Mott et al. | 61/87 |
| 3,955,621 | 5/1976 | Webb | 175/7 |
| 3,978,804 | 9/1976 | Beynet et al. | 61/98 X |

*Primary Examiner*—Jacob Shapiro
*Attorney, Agent, or Firm*—Walter Becker

[57] ABSTRACT

Pipes which are to be inserted vertically into the sea bed for the extraction of fluids therefrom, such as liquids and gases, are connected together in groups, with each pipe group being constructed on shore and then supported horizontally by the water while it is being moved to a platform site. The pipes are then flooded to turn the pipe package to a vertical position and the package is then connected with a platform by being engaged in a receiving groove in the platform edge. The pipe packages are then driven vertically into the sea bed and can then be fixedly connected to the platform and suitable connections made thereto for the flow of fluids upwardly in the sea bed through the pipe packages to the platform.

15 Claims, 14 Drawing Figures

1
2
3
4
5
6, 6a
11
28

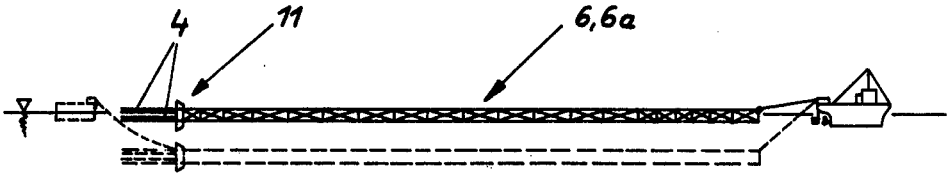
Fig. 12
Fig. 13
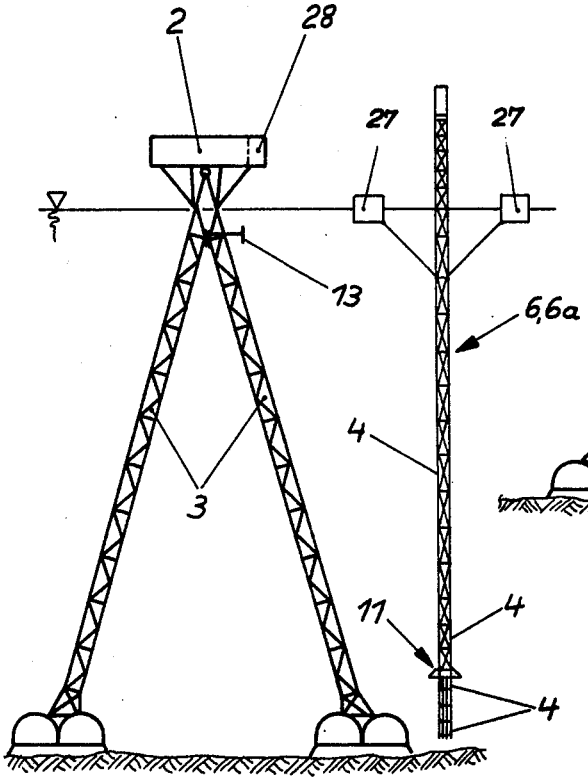
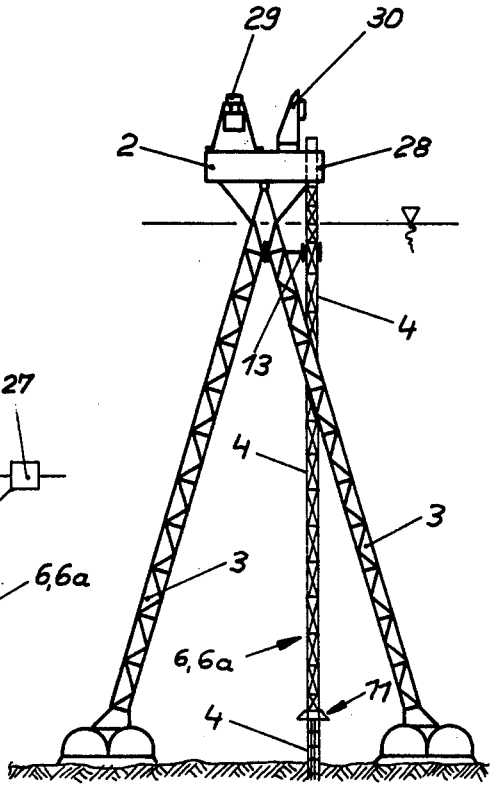
Fig. 14

METHOD AND APPARATUS FOR INSTALLING PIPES IN OFF-SHORE LOCATIONS

The invention relates to multiple piping (riser lines) for off-shore rigs or drilling platforms as they are employed for drilling bore holes into sub-sea deposits and extracting gases and liquids and which extend from the seabed to the deck of the rig.

Conventionally, the pipes making up such multiple riser lines are installed individually on the drilling or production rig after it has been erected, which not only is a time-consuming procedure but also involves a high investment in materials because each of the individual tubes is required singly to withstand the forces acting upon them.

It is, therefore, an object of the present invention to provide a more economical and stronger system of riser lines with the additional advantage that it will facilitate transport and installation of the piping on the off-shore rig.

The invention consists in forming the individual pipes of the multiple riser lines into a single package with the aid of connecting elements.

These and other objects and advantages of the invention will appear more clearly from the following specification in connection with the accompanying drawings, in which:

FIG. 12 shows a riser pipe package in the process of floating out.

FIG. 13 shows a phase during the installation of the riser pipe package on the platform structure.

FIG. 14 shows another phase during the installation of the riser pipe package.

Figures 1, 2:
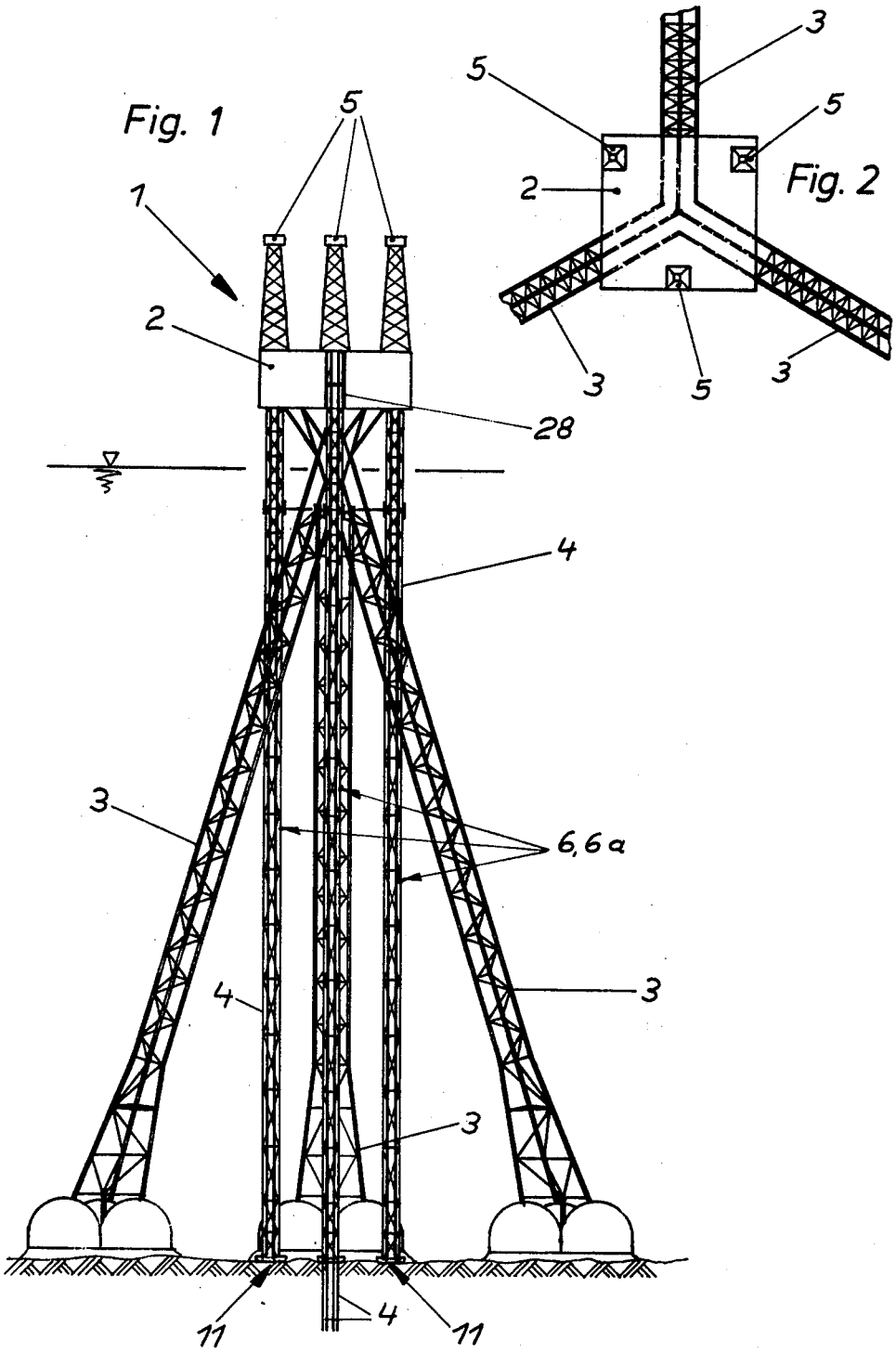
FIG. 1 shows a tripod-type off-shore platform in operational condition.
FIG. 2 is a plan view of the working deck.
Figure 3:
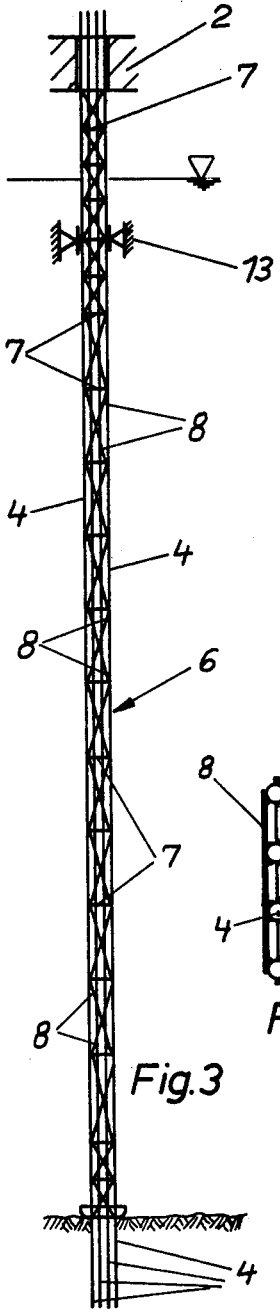
FIG. 3 is a group of riser pipes in the installed condition.
Figure 4:
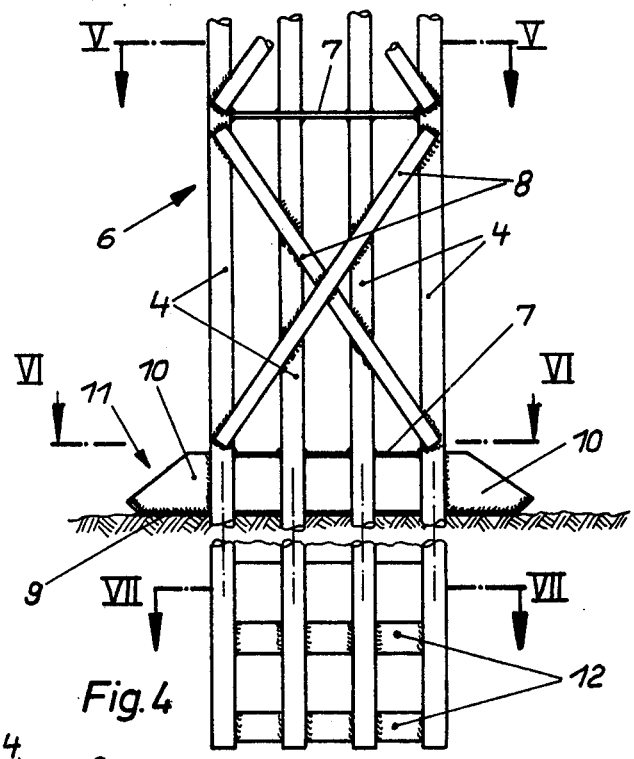
FIG. 4 is the sea bed end of the riser pipe package.
Figure 5:
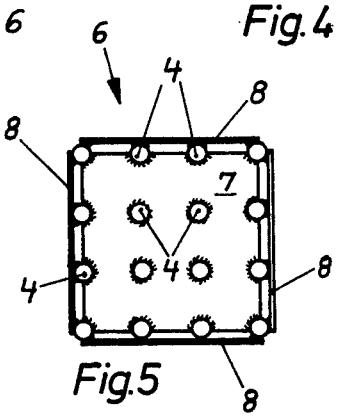
FIG. 5 is a section along the line V — V of FIG. 4.
Figure 7:
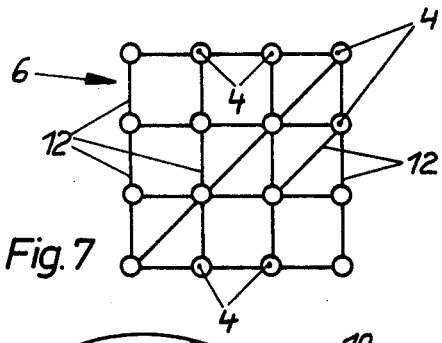
FIG. 7 is a section along the line VII — VII of FIG. 4.
Figure 6:
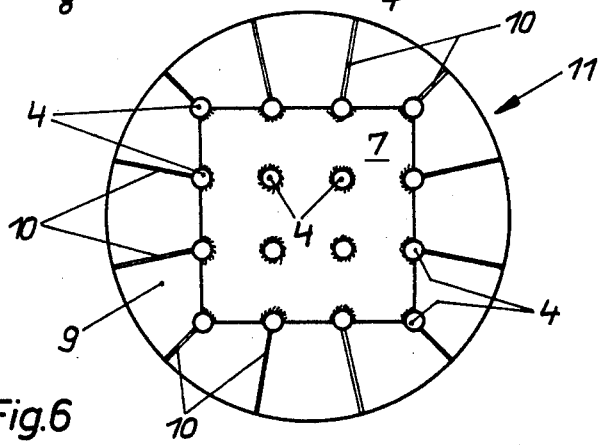
FIG. 6 is a section along the line VI — VI of FIG. 4.

The pipe assembly for off-shore drilling platforms according to the invention is characterized primarily in that the individual pipes of the assembly by means of connecting members form a single pipe package.

According to the method of this invention, the pipe package is launched in its horizontal position in which it was constructed, is towed to the intended site of the platform where practically in a submerged condition the individual pipes are flooded successively until the pipe package floats in a vertical stable position. The pipe package is applied laterally to the platform at the appropriate location, is driven into the sea bed until the footpad rests on the bottom of the sea, and by means of the support bearing is connected to the structure of the platform and at its upper part to the deck.

This method of compounding the riser pipes, which for good results may include nine or more pipes per package within a rectangular perimeter, makes it possible by static cooperation of the pipes to obtain a stiffness or rigidity exceeding that of an individual pipe by more than 2000 times. An individual pipe of the nature referred to is here assumed to have an outside diameter of 30 inches and a wall thickness of 1.5 inch, the spacing of the pipe centers being 2.4 meters in order to accommodate the pipe connections etc.

The relatively great wall thickness of 38 mm (1.5 inches) has hitherto been generally necessary in order to impart upon the individual pipe a greater stiffness and in order to avoid too close a spacing of the intermediate supports. In the statically combined pipe package, on the other hand, the stiffness (moment of inertia) is a linear function of the wall thickness, but is a square function of the spacing of the pipes so that it will be possible in this case to reduce the pipe wall thickness substantially or approximately to 20 mm. This is advantageous with respect to the cost of the riser pipes and their manipulation during transport and installation. It is to be assumed that the unusually great wall thickness which have been necessary to obtain adequate stiffness of the individual pipes will no longer be a critical consideration for the pipe package.

The general method of prefabricating the riser pipes under on-shore conditions and the installation thereof as a complete bundle on the off-shore rig enables substantial additional savings to be obtained in operation in addition to the saving of materials in the piping.

It is possible to equip the off-shore rig with one or two or three self-contained drill rigs in order to reduce the long period of time required to make the production bore holes proportionately. This riser line concept also opens up the possibility of fabricating pipe packages under on-shore conditions as required for operation, especially as it is designed so as to be able to float.

Two basic configurations are illustrated. One configuration has the pipe package fabricated with lattice members, diaphragms and a footpad in welded construction with all work done on a land-based site. The other configuration has a separable and lockable connection provided between the riser pipes and a support structure in such a manner that the riser pipes are a loosely fit in sections of locating tubes of the support structure.

Advantageously in an arrangement according to the present invention, the pipes form with the locating or guiding tubes sealed annular chambers into each of which leads an injection pipe communicating with a distributor for cement slurry in order to embed the pipes in concrete after the pipes have been pile-driven into the sea bed.

Depending on the respective requirements, the riser pipes extend beyond the footpad from ten to twenty, thirty or more meters. Because of the small footprint area, the bearing pressure is about 100 times the possible bearing capacity of the sea bed so that the deadweight of the flooded pipe package will ensure deep penetration of the package into the sea bed. Where necessary, penetration can be increased by applying to the package an additional force of a thousand tons or more. Penetration is complete when the large-area footpad comes to rest on the sea bed.

In order to be able to secure the riser pipes at only one point, in addition to their mounting on the deck and their bedding in the sea floor, namely a short distance below the surface of the sea, i.e. in the region of major load due to wind and waves, it is advisable to provide a support bearing on the off-shore platform. The design of the pipe package is laid out on the basis of a lattice structure taking into account its deadweight.

About 30 m depth of penetration would be adequate for the riser pipes. It is by this length that the riser pipes extend below a footpad (which may be of hollow steel plate construction or in the form of a concrete pad of round or square shape with about 20 m diameter or side length). The riser pipes are located relative to each other by means of narrow webs which only slightly increase their penetration resistance. Even where very great lengths are involved, the pipe package with its ends sealed, would be towed to the site where it is to be brought into a vertical position by partial flooding and positioned against the side of the platform structure as planned. Complete flooding and, if necessary, the application of a force at a point between the deck and the top closure of the riser pipes would enable the depth of penetration of the pipe package in the sea bed to be increased even more.

The length of the riser pipes is selected so that their upper ends reach the surface of the deck after they have been sunk into the sea floor to the desired depth. The deck is provided with recesses so that the pipe packages can be applied to the sides of the deck and to the support in the region of the leg joint of the platform structure.

The extension of the pipes to the top would be effected either by Rockwell joints or by welding. When driving-in the pipes from the deck, the necessary pipe lengths are added at the top.

The end face bearing pressure of the pipes is of the order of from 200 – 500 kg/cm$^2$. This is equivalent to approximately 100 times the carrying capacity of the sea bed so that the pipe package can positively be expected to penetrate into the sea bed about 30 m deep. Sinking of the pipe package will be stopped when the footpad comes to rest on the sea bed. Up to this point, the pipe package has been suspended from the deck. After the lattice members have become statically effective, the suspension is released, and the complete load of the riser pipe package transmitted directly into the sea bed.

It is conceivable, in order to have the package structurally connected during the transport thereof, to employ trussing or guying systems which can be detached later on when the package is submersed on location.

Referring now to the drawings in detail, the off-shore drilling platform 1 the working deck 2 of which is supported by three lattice-type legs 3, has attached thereto vertical riser pipes 4 arranged in three groups or packages (FIG. 1). The riser pipe packages are partly sunk into the sea bed and extend upwardly to the deck 2 where they are individually connected to three drilling masts 5 (FIG. 2). Seen from above, the drilling masts 5 with their associated pipe packages are arranged in the space between the legs 3.

As shown in FIGS. 3 to 7, each pipe package is constructed as an individual pipe bundle 6. To this end, the individual pipes 4 or pipe strands extend through and are welded to square-shaped diaphragms 7 which are arranged parallel to each other and along the respective pipe bundle 6. The diaphragms 7 are spaced from and arranged one above the other to locate the pipes in uniformly distributed relation over the periphery and inside the square. Arranged on the outsides of the square-shaped pipe package 6, there are provided braces 8 extending in pairs and diagonally between each group of two adjacent diaphragms 7 and thus having the form of the letter X. These braces are welded to the outer ones of pipes 4.

At a distance from 10 to 40 m from the lower end of the pipe package 6 and slightly below the lowermost diaphragm 7, the pipes 4 pass through a circular centrally arranged bottom plate 9 which projects outwardly beyond the circumference of the pipe package 6 and which is connected by radially disposed ribs 10 (FIGS. 4 and 6) to the outer pipes 4 and to the diaphragm 7 so that a strong footpad 11 is formed which prevents the pipe package 6 from sinking further into the sea bed than is required to bring footpad 11 to rest on the sea bed.

The free lower ends of the pipes 4 are interconnected by flat irons 12 placed on edge so that when entering the sea bed, they will together support the load while not interfering with the entry of the package into the sea bed.

A relatively short distance below the water level (about 20 m) the pipe package 6 is surrounded by a support bearing 13 (FIGS. 1 and 3) which is an integral part of the platform structure and which permits the pipe package 6 to be pile-driven into the sea bed when it is vertical and in the desired location. It is in the regions of the support bearing 13 and the footpad 11 that the greatest forces are expected to act upon the pipe package 6. Therefore, the diaphragms 7 are spaced closer here than over the rest of the pipe package 6.

Figure 8:
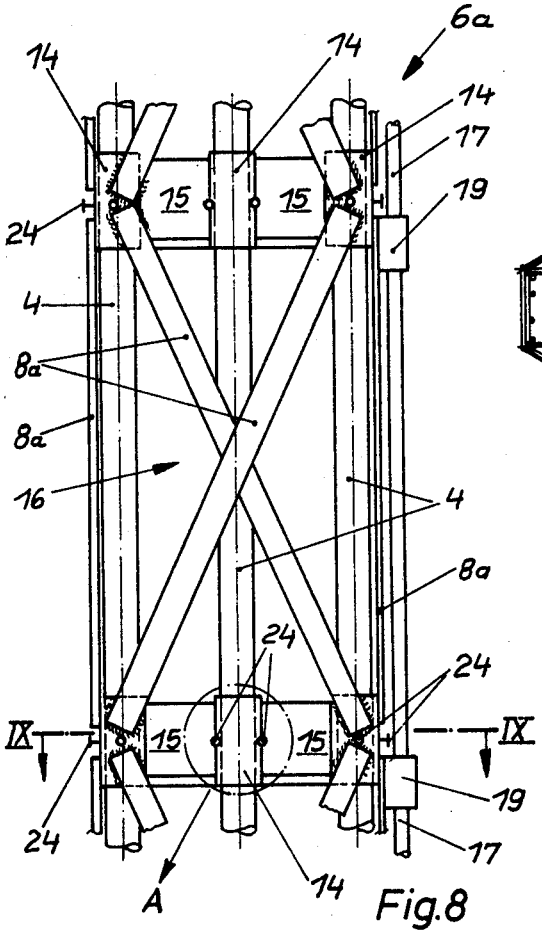
FIG. 8 is an alternative embodiment of the riser pipe package.
Figure 9:
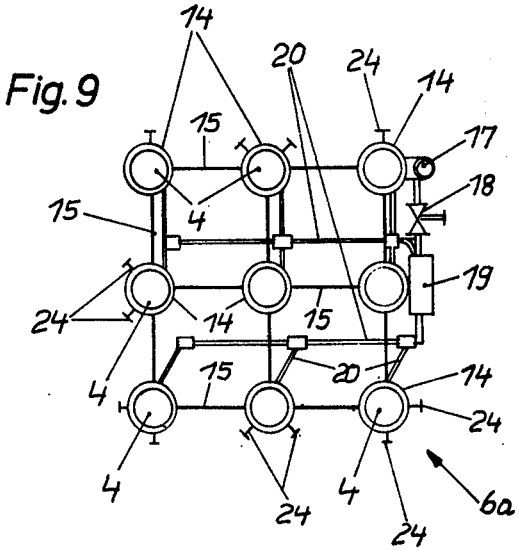
FIG. 9 is a section along the line IX — IX of FIG. 8.
Figure 10:
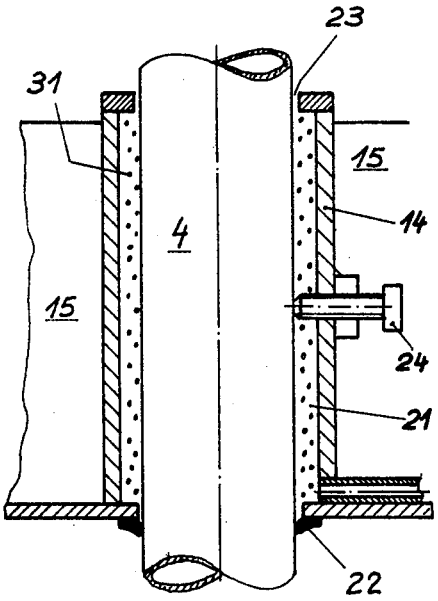
FIG. 10 is a sectioned detail marked by a circle in FIG. 8.

Whereas the pipe package 6 described above is designed, during installation, to penetrate into the sea bed as an integral unit, a pipe package **6*a* according to FIGS. 8 to 10 enables the pipes 4 to be pile-driven individually into the sea bed with the pipes 4 being displaceably received by a framework-like supporting system 16**.

With this modification, the diaphragms 7 of the pipe package 6 are supplemented by sections of guiding tubes 14 which receive the pipes 4 with play and which are interconnected by vertical connecting plates 15. The individual tiers of guiding or locating tubes 14 are supported by braces **8*a* similar to braces 8 of FIG. 4**.

Alongside the pipe package **6*a* there is arranged a main pipe 17 (FIGS. 8 and 9) with branch-offs at the levels of the locating or guiding tubes 14 to supply cement slurry through a valve 18 to a distributor 19. The latter is connected by injection pipes 20 with the annular chamber 21 (FIG. 10) formed between the pipes 4 and the guiding tubes 14 and having a seal 22 at the bottom portion and a constriction 23 at the top portion. Clamping screws 24 fitted in the guiding tubes 14 serve to locate the pipes 4 in the support structure 16 prior to the pipes 4** being pile-driven.

After the pipes 4 have reached their operational position in the sea bed and with respect to the deck 2, they will be firmly connected to the support frame 16 by concrete filling 31 in the annular chamber 21.

Figure 11:
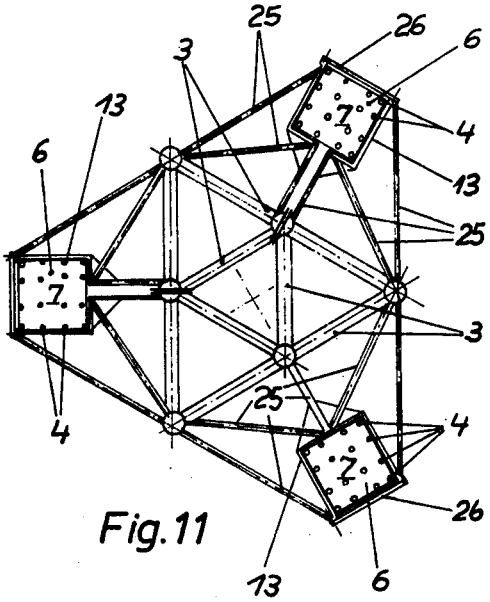
FIG. 11 shows the method of locating the riser pipe packages on the platform structure below the water level.

FIG. 11 shows the method of supporting the pipe package 6 or **6*a* in the support bearings 13. The support bearings 13 are tied by means of members 25 to the legs 3 and are formed to match the contour of the pipe packages 6 or 6*a*. The bearings are provided with holding or closing members 26 toward the outside which are applied after the pipe packages 6 or 6*a*** have been installed.

The pipe packages 6 or **6*a***, which are capable of being floated out of the work site, are built horizontally, i.e.

lying on the ground, on shore and, after their ends have been sealed, are towed in this position to the work site. The transport may be effected on the water, or with the pipes 4 partially flooded, immersed in the water (FIG. 12).

At the site of the off-shore platform 1 (FIGS. 13 and 14), the pipe packages are flooded to bring them into a vertical floating position, if necessary, with the aid of additional buoyancy tanks 27, and are then introduced laterally into a recess 28 of the working deck 2 and into the support bearing 13 therebelow. After fitting the closing members 26 on bearing 13, the pipe packages 6 or 6*a* are pile-driven into the sea bed. This may be carried out by engagement with the upper end of a pipe package by a hydraulic downthrust installation 29 or by a pile driving installation 30. Finally, the pipe packages are secured to the deck 2.

An alternative method of installing the pipe packages consists in hinging them to the drilling platform structure 1 and slowly lowering their free end onto the sea bed.

It is, of course, to be understood that the present invention is, by no means, limited to the specific showing in the drawings but also comprises any modifications within the scope of the appended claims.

What is claimed is:

1. In an off-shore installation for extracting fluids from the sea bed and including a platform into the sea bed and operable to conduct the fluid from the point of extraction thereof from the sea bed to the platform, the improvement in combination therewith which comprises; at least two pipes in parallel coextensive relation forming a group, and members connecting the pipes of the group together as a complete bundle fabricated on-shore to form a unitary assembly or pipe package effective for transport and installation off-shore, said connecting members including sleeve portions surrounding the pies of the respective group, the pipes being axially movable in said sleeve portions, and means for locking the pipes to the respective sleeve portions.

2. An off-shore installation in combination according to claim 1 in which the assembly is bouyant in water when the ends of the pipes thereof are sealed closed.

3. An off-shore installation in combination according to claim 1 in which each group of pipes and the connecting members are square when viewed in the direction of the axes of the pipes.

4. An off-shore installation in combination according to claim 1 in which said members are flat diaphragms in planes perpendicular to the axes of the pipes and spaced therealong, and braces extending diagonally between said diaphragms at the diaphragm edges and fixed to the diaphragms.

5. An off-shore installation in combination according to claim 1 which includes a foot element on the pipe group near the sea bed end of the group, said element being in a plane perpendicular to the axes of said pipes and protruding outwardly a substantial distance from the outer limits of the respective group.

6. An off-shore installation in combination according to claim 1 which includes support bearing means on said platform near the upper end of the said group and slidably engaging the said group.

7. An off-shore installation in combination according to claim 5 which includes flat support plates in planes parallel to the axes of the pipes extending between and fixed to the pipes, said plates being disposed between said foot element and the sea bed end of said pipes.

8. An off-shore installation in combination according to claim 1 in which said group is fixed to an edge portion of said platform.

9. An off-shore installation in combination according to claim 1 in which the platform has recesses formed into the edges thereof, and a respective group or pipe package in each recess.

10. In an off-shore installation for extracting fluids from the sea bed and including a platform into the sea bed and operable to conduct the fluid from the point of extraction thereof from the sea bed to the platform, the improvement in combination therewith which comprises; at least two pipes in parallel coextensive relation forming a group, and members connecting the pipes of the group together as a complete bundle fabricated on-shore to form a unitary assembly or pipe package effective for transport and installation off-shore, legs surrounding said platform and angling outwardly therefrom in the downward direction, said platform having recesses in the edges thereof between said legs, and a respective group or pipe package extending vertically through each recess and between the adjacent legs.

11. In an off-shore installation for extracting fluids from the sea bed and including a platform into the sea bed and operable to conduct the fluid from the point of extraction thereof from the sea bed to the platform, the improvement in combination therewith which comprises; at least two pipes in parallel coextensive relation forming a group, and members connecting the pipes of the group together as a complete bundle fabricated on-shore to form a unitary assembly or pipe package effective for transport and installation off-shore, said connecting members including sleeve portions surrounding the pipes of the respective group, each pipe and the respective sleeve portion confining therebetween a closed annulus, and means for supplying a slurry of settable material to said annulus to fix the pipe in the respective sleeve portion.

12. An off-shore installation in combination according to claim 11 in which said material is concrete.

13. The method of installing a pipe package in operative position relative to an off-shore platform with the package extending vertically downwardly from the platform into the sea bed, said method comprising; constructing the pipe package on shore, supporting the package in horizontal position in the water and moving the thus supported package to the platform site, flooding pipes of the package to cause the package to assume a vertical position in the water, engaging the package with the edge of the platform, driving the package downwardly to cause the lower ends of the pipes thereof to penetrate the sea bed, and connecting the package to the platform.

14. The method according to claim 13 which includes placing a bearing beneath the platform, guiding the package in vertical movement in the bearing, and fixing the pipes when driven into the sea bed to the bearing.

15. The method according to claim 13 which includes embedding the base region of the package in concrete.

* * * * *